US009745981B2

(12) United States Patent
Dos Reis et al.

(10) Patent No.: US 9,745,981 B2
(45) Date of Patent: Aug. 29, 2017

(54) FAN ASSEMBLY

(71) Applicant: Dyson Technology Limited, Wiltshire (GB)

(72) Inventors: David Dos Reis, Malmesbury (GB); Daniel George Cowen, Malmesbury (GB); Peter David Gammack, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 465 days.

(21) Appl. No.: 13/673,632

(22) Filed: Nov. 9, 2012

(65) Prior Publication Data

US 2013/0129490 A1 May 23, 2013

(30) Foreign Application Priority Data

Nov. 11, 2011 (GB) ..... 1119500.5
Mar. 29, 2012 (GB) ..... 1205576.0

(51) Int. Cl.
*F04D 29/42* (2006.01)
*F04D 3/00* (2006.01)
(Continued)

(52) U.S. Cl.
CPC ..... *F04D 3/00* (2013.01); *F04D 25/08* (2013.01); *F04F 5/16* (2013.01); *F24F 7/007* (2013.01); *F24F 2221/28* (2013.01)

(58) Field of Classification Search
CPC ..... F04D 19/002; F04D 25/08; F04D 25/10; F04D 29/44; F04D 29/441; F04D 29/52;
(Continued)

(56) References Cited

U.S. PATENT DOCUMENTS 284,962 A 9/1883 Huston
1,357,261 A 11/1920 Svoboda
(Continued)

FOREIGN PATENT DOCUMENTS

BE 560119 8/1957
CA 1055344 5/1979
(Continued)

OTHER PUBLICATIONS

Search Report dated Jul. 16, 2012, directed to GB Application No. 1205576.0; 1 page.
(Continued)

*Primary Examiner* — Eric Keasel
*Assistant Examiner* — Jason Mikus
(74) *Attorney, Agent, or Firm* — Morrison & Foerster LLP

(57) ABSTRACT

A nozzle for a fan assembly has an air inlet, an annular air outlet, and an interior passage for conveying air from the air inlet to the air outlet. The interior passage is located between an annular inner wall, and an outer wall extending about the inner wall. The inner wall at least partially defines a bore through which air from outside the nozzle is drawn by air emitted from the air outlet. The inner wall is eccentric with respect to the outer wall so that the cross-sectional area of the interior passage varies about the bore. The variation in the cross-sectional area of the interior passage can control the direction in which air is emitted from around the air outlet to reduce turbulence in the air flow generated by the fan assembly.

17 Claims, 6 Drawing Sheets

(51) Int. Cl.
*F04F 5/16* (2006.01)
*F04D 25/08* (2006.01)
*F24F 7/007* (2006.01)

(58) Field of Classification Search
CPC ..... F04D 29/522; F04D 29/54; F04D 29/541; F04D 29/545; F04D 29/4226; F04D 17/16; F05D 2240/128
USPC ..... 415/211.2; 417/196, 197, 198
See application file for complete search history.

(56) References Cited

U.S. PATENT DOCUMENTS 1,767,060 A 6/1930 Ferguson
1,896,869 A 2/1933 Larsh
2,014,185 A 9/1935 Martin
2,035,733 A 3/1936 Wall
2,071,266 A 2/1937 Schmidt
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,295,502 A 9/1942 Lamb
2,336,295 A 12/1943 Reimuller
2,363,839 A 11/1944 Demuth
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,711,682 A 6/1955 Drechsel
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Berlin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,503,138 A 3/1970 Fuchs et al.
3,518,776 A 7/1970 Wolff et al.
3,724,092 A 4/1973 McCleerey
3,729,934 A 5/1973 Denning et al.
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,090,814 A 5/1978 Teodorescu et al.
4,113,416 A 9/1978 Kataoka et al.
4,136,735 A 1/1979 Beck et al.
4,173,995 A 11/1979 Beck
4,180,130 A 12/1979 Beck et al.
4,184,417 A 1/1980 Chancellor
4,184,541 A 1/1980 Beck et al.
4,192,461 A * 3/1980 Arborg ..... 239/265.17
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,716,946 A 1/1988 Grigoletto
4,718,870 A 1/1988 Watts
4,732,539 A 3/1988 Shin-Chin
4,734,017 A 3/1988 Levin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger
5,061,405 A 10/1991 Stanek et al.
D325,435 S 4/1992 Coup et al.
5,110,266 A 5/1992 Toyoshima et al.
5,168,722 A 12/1992 Brock
5,176,856 A 1/1993 Takahashi et al.
5,188,508 A 2/1993 Scott et al.
D343,231 S 1/1994 Lim
5,296,769 A 3/1994 Havens et al.
D346,017 S 4/1994 Lim
5,310,313 A 5/1994 Chen
5,317,815 A 6/1994 Hwang
5,338,495 A 8/1994 Steiner et al.
5,402,938 A 4/1995 Sweeney
5,407,324 A 4/1995 Starnes, Jr. et al.
5,425,902 A 6/1995 Miller et al.
5,435,489 A 7/1995 Jenkins et al.
5,483,616 A 1/1996 Chiu et al.
5,518,370 A 5/1996 Wang et al.
D374,712 S 10/1996 Jane et al.
5,609,473 A 3/1997 Litvin
5,645,769 A 7/1997 Tamaru et al.
5,649,370 A 7/1997 Russo
D382,951 S 8/1997 Deines et al.
5,671,321 A 9/1997 Bagnuolo
5,677,982 A 10/1997 Levine et al.
5,735,683 A 4/1998 Muschelknautz
5,762,034 A 6/1998 Foss
5,762,661 A 6/1998 Kleinberger et al.
5,783,117 A 7/1998 Byassee et al.
5,794,306 A 8/1998 Firdaus
D398,983 S 9/1998 Keller et al.
5,841,080 A 11/1998 Iida et al.
5,843,344 A 12/1998 Junkel et al.
5,859,952 A 1/1999 Levine et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
D423,663 S 4/2000 Rossman et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
6,604,694 B1 8/2003 Kordas et al.
D483,851 S 12/2003 Fok
D485,895 S 1/2004 Melwani
D486,903 S 2/2004 Chiang
6,789,787 B2 9/2004 Stutts
6,791,056 B2 9/2004 VanOtteren et al.
6,830,433 B2 12/2004 Birdsell et al.
6,845,971 B2 1/2005 Bachert
D512,772 S 12/2005 Lee
D513,067 S 12/2005 Blateri
7,059,826 B2 6/2006 Lasko
7,088,913 B1 8/2006 Verhoorn et al.
7,147,336 B1 12/2006 Chou
D539,414 S 3/2007 Russak et al.

(56) References Cited

U.S. PATENT DOCUMENTS 7,192,258 B2 3/2007 Kuo et al.
7,198,473 B2 4/2007 Stickland et al.
7,412,781 B2 8/2008 Mattinger et al.
7,478,993 B2 1/2009 Hong et al.
7,540,474 B1 6/2009 Huang et al.
D595,835 S 7/2009 Fu
D598,532 S 8/2009 Dyson et al.
D602,143 S 10/2009 Gammack et al.
D602,144 S 10/2009 Dyson et al.
D605,748 S 12/2009 Gammack et al.
7,660,110 B2 2/2010 Vinson et al.
7,664,377 B2 2/2010 Liao
D614,280 S 4/2010 Dyson et al.
7,731,050 B2 6/2010 Parks et al.
7,775,848 B1 8/2010 Auerbach
7,806,388 B2 10/2010 Junkel et al.
7,841,045 B2 11/2010 Shaanan et al.
D633,997 S 3/2011 Hideharu et al.
D633,999 S 3/2011 Hideharu et al.
7,931,449 B2 4/2011 Fitton et al.
D638,114 S 5/2011 Li et al.
D643,098 S 8/2011 Wallace et al.
8,002,520 B2 8/2011 Dawson et al.
D646,373 S 10/2011 Liebson et al.
8,092,166 B2 1/2012 Nicolas et al.
8,113,490 B2 2/2012 Chen
8,152,495 B2 4/2012 Boggess, Jr. et al.
8,246,317 B2 8/2012 Gammack
D669,164 S 10/2012 Hsu
8,308,445 B2 11/2012 Gammack et al.
D672,023 S 12/2012 Wallace et al.
D672,024 S 12/2012 Fitton et al.
8,348,629 B2 1/2013 Fitton et al.
8,356,804 B2 1/2013 Fitton et al.
D678,993 S 3/2013 Kung-Hua
8,403,640 B2 3/2013 Gammack et al.
8,408,869 B2 4/2013 Hutton et al.
D681,793 S 5/2013 Li
D684,249 S 6/2013 Herbst
8,454,322 B2 6/2013 Gammack et al.
8,469,660 B2 6/2013 Dyson et al.
8,529,226 B2 9/2013 Li
8,544,826 B2 10/2013 Ediger et al.
D700,959 S 3/2014 Sickinger et al.
8,684,687 B2 4/2014 Dyson et al.
D705,415 S 5/2014 Lo
8,721,286 B2 5/2014 Gammack et al.
8,721,307 B2 5/2014 Li
8,764,412 B2 7/2014 Gammack et al.
8,783,663 B2 7/2014 Fitton et al.
8,784,071 B2 7/2014 Gammack
2002/0104972 A1 8/2002 Guzorek
2002/0106547 A1 8/2002 Sugawara et al.
2003/0059307 A1 3/2003 Moreno et al.
2003/0164367 A1 9/2003 Bucher et al.
2003/0171093 A1 9/2003 Gumucio Del Pozo
2003/0190183 A1 10/2003 Hsing
2004/0022631 A1 2/2004 Birdsell et al.
2004/0049842 A1 3/2004 Prehodka
2004/0106370 A1 6/2004 Honda et al.
2004/0149881 A1 8/2004 Allen
2005/0031448 A1 2/2005 Lasko et al.
2005/0053465 A1 3/2005 Roach et al.
2005/0069407 A1 3/2005 Winkler et al.
2005/0128698 A1 6/2005 Huang
2005/0163670 A1 7/2005 Alleyne et al.
2005/0173997 A1 8/2005 Schmid et al.
2005/0281672 A1 12/2005 Parker et al.
2006/0172682 A1 8/2006 Orr et al.
2006/0199515 A1 9/2006 Lasko et al.
2006/0263073 A1 11/2006 Clarke et al.
2006/0279927 A1 12/2006 Strohm
2007/0035189 A1 2/2007 Matsumoto
2007/0041857 A1 2/2007 Fleig
2007/0065280 A1 3/2007 Fok
2007/0166160 A1 7/2007 Russak et al.
2007/0176502 A1 8/2007 Kasai et al.
2007/0224044 A1 9/2007 Hong et al.
2007/0237500 A1 10/2007 Wang
2007/0269323 A1 11/2007 Zhou et al.
2008/0020698 A1 1/2008 Spaggiari
2008/0124060 A1 5/2008 Gao
2008/0152482 A1 6/2008 Patel
2008/0166224 A1 7/2008 Giffin
2008/0286130 A1 11/2008 Purvines
2008/0314250 A1 12/2008 Cowie et al.
2009/0026850 A1 1/2009 Fu
2009/0032130 A1 2/2009 Dumas et al.
2009/0039805 A1 2/2009 Tang
2009/0060710 A1 3/2009 Gammack et al.
2009/0060711 A1 3/2009 Gammack et al.
2009/0078120 A1 3/2009 Kummer et al.
2009/0120925 A1 5/2009 Lasko
2009/0191054 A1 7/2009 Winkler
2009/0214341 A1 8/2009 Craig
2010/0133707 A1 6/2010 Huang
2010/0150699 A1 6/2010 Nicolas et al.
2010/0162011 A1 6/2010 Min
2010/0171465 A1 7/2010 Seal et al.
2010/0225012 A1* 9/2010 Fitton ..... F24F 1/01 261/116
2010/0226749 A1 9/2010 Gammack et al.
2010/0226750 A1 9/2010 Gammack
2010/0226751 A1 9/2010 Gammack et al.
2010/0226752 A1 9/2010 Gammack et al.
2010/0226753 A1 9/2010 Dyson et al.
2010/0226754 A1 9/2010 Hutton et al.
2010/0226758 A1 9/2010 Cookson et al.
2010/0226763 A1 9/2010 Gammack et al.
2010/0226764 A1 9/2010 Gammack et al.
2010/0226769 A1 9/2010 Helps
2010/0226771 A1 9/2010 Crawford et al.
2010/0226787 A1 9/2010 Gammack et al.
2010/0226797 A1 9/2010 Fitton et al.
2010/0226801 A1 9/2010 Gammack
2010/0254800 A1 10/2010 Fitton et al.
2011/0058935 A1 3/2011 Gammack et al.
2011/0110805 A1 5/2011 Gammack et al.
2011/0164959 A1 7/2011 Fitton et al.
2011/0223014 A1 9/2011 Crawford et al.
2011/0223015 A1 9/2011 Gammack et al.
2011/0236228 A1 9/2011 Fitton et al.
2012/0031509 A1 2/2012 Wallace et al.
2012/0033952 A1 2/2012 Wallace et al.
2012/0034108 A1 2/2012 Wallace et al.
2012/0039705 A1 2/2012 Gammack
2012/0045315 A1 2/2012 Gammack
2012/0045316 A1 2/2012 Gammack
2012/0057959 A1 3/2012 Hodgson et al.
2012/0082561 A1 4/2012 Gammack et al.
2012/0093629 A1 4/2012 Fitton et al.
2012/0093630 A1 4/2012 Fitton et al.
2012/0114513 A1 5/2012 Simmonds et al.
2012/0230658 A1 9/2012 Fitton et al.
2012/0308375 A1 12/2012 Gammack
2013/0011252 A1 1/2013 Crawford et al.
2013/0026664 A1 1/2013 Staniforth et al.
2013/0028763 A1 1/2013 Staniforth et al.
2013/0028766 A1 1/2013 Staniforth et al.
2013/0142676 A1 6/2013 Zou
2013/0161842 A1 6/2013 Fitton et al.
2013/0199372 A1 8/2013 Nock et al.
2013/0234346 A1 9/2013 Staniforth et al.
2013/0234347 A1 9/2013 Staniforth et al.
2013/0249122 A1 9/2013 Staniforth et al.
2013/0249124 A1 9/2013 Staniforth et al.
2013/0249126 A1 9/2013 Staniforth et al.
2013/0272858 A1 10/2013 Stickney et al.
2013/0280051 A1 10/2013 Nicolas et al.
2013/0280061 A1 10/2013 Stickney
2013/0280096 A1 10/2013 Gammack et al.
2013/0309065 A1 11/2013 Johnson et al.
2013/0309080 A1 11/2013 Johnson et al.
2013/0323100 A1 12/2013 Poulton et al.

(56) References Cited

U.S. PATENT DOCUMENTS

| | | | |
|---|---|---|---|
| 2013/0336771 | A1 | 12/2013 | Dyson et al. |
| 2014/0017069 | A1 | 1/2014 | Peters |
| 2014/0077398 | A1 | 3/2014 | Staniforth et al. |
| 2014/0079566 | A1 | 3/2014 | Gammack et al. |
| 2014/0084492 | A1 | 3/2014 | Staniforth et al. |
| 2014/0210114 | A1 | 7/2014 | Staniforth et al. |
| 2014/0210115 | A1 | 7/2014 | Staniforth et al. |
| 2014/0255173 | A1 | 9/2014 | Poulton et al. |
| 2014/0255217 | A1 | 9/2014 | Li |

FOREIGN PATENT DOCUMENTS

| | | | |
|---|---|---|---|
| CA | 2155482 | | 9/1996 |
| CH | 346643 | | 5/1960 |
| CN | 2085866 | | 10/1991 |
| CN | 2111392 | | 7/1992 |
| CN | 2549372 | | 5/2003 |
| CN | 1437300 | | 8/2003 |
| CN | 2650005 | | 10/2004 |
| CN | 2713643 | | 7/2005 |
| CN | 1680727 | | 10/2005 |
| CN | 2833197 | | 11/2006 |
| CN | 201011346 | | 1/2008 |
| CN | 201147215 | | 11/2008 |
| CN | 201180678 | | 1/2009 |
| CN | 201221477 | | 4/2009 |
| CN | 101424279 | | 5/2009 |
| CN | 101451754 | | 6/2009 |
| CN | 201281416 | | 7/2009 |
| CN | 201349269 | | 11/2009 |
| CN | 101684828 | | 3/2010 |
| CN | 201486901 | | 5/2010 |
| CN | 101749288 | | 6/2010 |
| CN | 201502549 | | 6/2010 |
| CN | 201507461 | | 6/2010 |
| CN | 101825096 | | 9/2010 |
| CN | 101825101 | | 9/2010 |
| CN | 101825102 | | 9/2010 |
| CN | 101825103 | A | 9/2010 |
| CN | 101825104 | | 9/2010 |
| CN | 201568337 | | 9/2010 |
| CN | 101858355 | | 10/2010 |
| CN | 101936310 | | 1/2011 |
| CN | 201696365 | U | 1/2011 |
| CN | 201696366 | | 1/2011 |
| CN | 201739198 | | 2/2011 |
| CN | 201739199 | U | 2/2011 |
| CN | 101984299 | | 3/2011 |
| CN | 101985948 | | 3/2011 |
| CN | 201763705 | | 3/2011 |
| CN | 201763706 | | 3/2011 |
| CN | 201770513 | | 3/2011 |
| CN | 201771875 | | 3/2011 |
| CN | 201779080 | | 3/2011 |
| CN | 201786777 | | 4/2011 |
| CN | 201786778 | | 4/2011 |
| CN | 201802648 | | 4/2011 |
| CN | 301539668 | | 5/2011 |
| CN | 102095236 | | 6/2011 |
| CN | 201858204 | | 6/2011 |
| CN | 201874898 | | 6/2011 |
| CN | 201874901 | U | 6/2011 |
| CN | 201917047 | | 8/2011 |
| CN | 102251973 | A | 11/2011 |
| CN | 102287357 | | 12/2011 |
| CN | 102367813 | | 3/2012 |
| CN | 202267207 | | 6/2012 |
| CN | 301949285 | | 6/2012 |
| CN | 202338473 | | 7/2012 |
| CN | 202431623 | | 9/2012 |
| DE | 1 291 090 | | 3/1969 |
| DE | 24 51 557 | | 5/1976 |
| DE | 27 48 724 | | 5/1978 |
| DE | 3644567 | | 7/1988 |
| DE | 195 10 397 | | 9/1996 |
| DE | 197 12 228 | | 10/1998 |
| DE | 100 00 400 | | 3/2001 |
| DE | 10041805 | | 6/2002 |
| DE | 10 2009 007 037 | | 8/2010 |
| EP | 0 044 494 | | 1/1982 |
| EP | 0186581 | | 7/1986 |
| EP | 0 459 812 | | 12/1991 |
| EP | 0 784 947 | | 7/1997 |
| EP | 1 094 224 | | 4/2001 |
| EP | 1 138 954 | | 10/2001 |
| EP | 1357296 | B1 | 10/2003 |
| EP | 1 779 745 | | 5/2007 |
| EP | 1 939 456 | | 7/2008 |
| EP | 1 980 432 | | 10/2008 |
| EP | 2 000 675 | | 12/2008 |
| EP | 2191142 | | 6/2010 |
| EP | 2 414 738 | | 2/2012 |
| EP | 2 578 889 | | 4/2013 |
| FR | 1033034 | | 7/1953 |
| FR | 1119439 | | 6/1956 |
| FR | 1.387.334 | | 1/1965 |
| FR | 2 375 471 | | 7/1978 |
| FR | 2 534 983 | | 4/1984 |
| FR | 2 640 857 | | 6/1990 |
| FR | 2 658 593 | | 8/1991 |
| FR | 2794195 | | 12/2000 |
| FR | 2 874 409 | | 2/2006 |
| FR | 2 906 980 | | 4/2008 |
| FR | 2928706 | | 9/2009 |
| GB | 22235 | | 6/1914 |
| GB | 383498 | | 11/1932 |
| GB | 593828 | | 10/1947 |
| GB | 601222 | | 4/1948 |
| GB | 633273 | | 12/1949 |
| GB | 641622 | | 8/1950 |
| GB | 661747 | | 11/1951 |
| GB | 863 124 | | 3/1961 |
| GB | 1067956 | | 5/1967 |
| GB | 1 262 131 | | 2/1972 |
| GB | 1 265 341 | | 3/1972 |
| GB | 1 278 606 | | 6/1972 |
| GB | 1 304 560 | | 1/1973 |
| GB | 1 403 188 | | 8/1975 |
| GB | 1 434 226 | | 5/1976 |
| GB | 1 501 473 | | 2/1978 |
| GB | 2 094 400 | | 9/1982 |
| GB | 2 107 787 | | 5/1983 |
| GB | 2 111 125 | | 6/1983 |
| GB | 2 178 256 | | 2/1987 |
| GB | 2 185 531 | | 7/1987 |
| GB | 2 185 533 | | 7/1987 |
| GB | 2 218 196 | | 11/1989 |
| GB | 2 236 804 | | 4/1991 |
| GB | 2 240 268 | | 7/1991 |
| GB | 2 242 935 | | 10/1991 |
| GB | 2 285 504 | | 7/1995 |
| GB | 2 289 087 | | 11/1995 |
| GB | 2383277 | | 6/2003 |
| GB | 2 428 569 | | 2/2007 |
| GB | 2 452 593 | | 3/2009 |
| GB | 2452490 | | 3/2009 |
| GB | 2463698 | | 3/2010 |
| GB | 2464736 | | 4/2010 |
| GB | 2466058 | | 6/2010 |
| GB | 2468312 | | 9/2010 |
| GB | 2468313 | | 9/2010 |
| GB | 2468315 | | 9/2010 |
| GB | 2468317 | A | 9/2010 |
| GB | 2468319 | | 9/2010 |
| GB | 2468320 | | 9/2010 |
| GB | 2468323 | | 9/2010 |
| GB | 2468328 | | 9/2010 |
| GB | 2468329 | | 9/2010 |
| GB | 2468331 | | 9/2010 |
| GB | 2468369 | | 9/2010 |
| GB | 2468498 | | 9/2010 |
| GB | 2473037 | | 3/2011 |
| GB | 2479760 | | 10/2011 |
| GB | 2482547 | | 2/2012 |

(56) References Cited

FOREIGN PATENT DOCUMENTS

| | | | |
|---|---|---|---|
| GB | 2484671 | | 4/2012 |
| GB | 2484695 | A | 4/2012 |
| GB | 2484761 | | 4/2012 |
| GB | 2493231 | A | 1/2013 |
| GB | 2493505 | A | 2/2013 |
| GB | 2493507 | A | 2/2013 |
| GB | 2500011 | | 9/2013 |
| JP | 31-13055 | | 8/1956 |
| JP | 35-4369 | | 3/1960 |
| JP | 39-7297 | | 3/1964 |
| JP | 46-7230 | | 12/1971 |
| JP | 47-21718 | | 10/1972 |
| JP | 49-43764 | | 4/1974 |
| JP | 49-150403 | | 12/1974 |
| JP | 51-7258 | | 1/1976 |
| JP | 52-121045 | | 9/1977 |
| JP | 53-60100 | | 5/1978 |
| JP | 56-167897 | | 12/1981 |
| JP | 57-71000 | | 5/1982 |
| JP | 57-157097 | | 9/1982 |
| JP | 61-31830 | | 2/1986 |
| JP | 61-116093 | | 6/1986 |
| JP | 61-280787 | | 12/1986 |
| JP | 62-98099 | | 5/1987 |
| JP | 62-223494 | | 10/1987 |
| JP | 63-36794 | | 3/1988 |
| JP | 63-179198 | | 7/1988 |
| JP | 63-198933 | | 12/1988 |
| JP | 63-306340 | | 12/1988 |
| JP | 64-21300 | | 2/1989 |
| JP | 64-58955 | | 3/1989 |
| JP | 64-83884 | | 3/1989 |
| JP | 1-138399 | | 5/1989 |
| JP | 1-224598 | | 9/1989 |
| JP | 2-146294 | | 6/1990 |
| JP | 2-218890 | | 8/1990 |
| JP | 2-248690 | | 10/1990 |
| JP | 3-52515 | | 5/1991 |
| JP | 3-267598 | | 11/1991 |
| JP | 3-286775 | | 12/1991 |
| JP | 4-43895 | | 2/1992 |
| JP | 4-366330 | | 12/1992 |
| JP | 5-99386 | | 4/1993 |
| JP | 5-157093 | | 6/1993 |
| JP | 5-164089 | | 6/1993 |
| JP | 5-263786 | | 10/1993 |
| JP | 6-74190 | | 3/1994 |
| JP | 6-86898 | | 3/1994 |
| JP | 6-147188 | | 5/1994 |
| JP | 6-257591 | | 9/1994 |
| JP | 6-280800 | | 10/1994 |
| JP | 6-336113 | | 12/1994 |
| JP | 7-190443 | | 7/1995 |
| JP | 8-21400 | | 1/1996 |
| JP | 8-72525 | | 3/1996 |
| JP | 8-313019 | | 11/1996 |
| JP | 9-100800 | | 4/1997 |
| JP | 9-178083 | | 7/1997 |
| JP | 9-287600 | | 11/1997 |
| JP | 11-502586 | | 3/1999 |
| JP | 11-227866 | | 8/1999 |
| JP | 2000-55419 | | 2/2000 |
| JP | 2000-116179 | | 4/2000 |
| JP | 2000-201723 | | 7/2000 |
| JP | 2001-17358 | | 1/2001 |
| JP | 2002-21797 | | 1/2002 |
| JP | 2002-138829 | | 5/2002 |
| JP | 2002-213388 | | 7/2002 |
| JP | 2003-4265 | | 1/2003 |
| JP | 2003-329273 | | 11/2003 |
| JP | 2004-8275 | | 1/2004 |
| JP | 2004-208935 | | 7/2004 |
| JP | 2004-216221 | | 8/2004 |
| JP | 2005-201507 | | 7/2005 |
| JP | 2005-307985 | | 11/2005 |
| JP | 2006-89096 | | 4/2006 |
| JP | 2006-189221 | | 7/2006 |
| JP | 3127331 | | 11/2006 |
| JP | 2007-138763 | | 6/2007 |
| JP | 2007-138789 | | 6/2007 |
| JP | 2008-39316 | | 2/2008 |
| JP | 2008-100204 | | 5/2008 |
| JP | 3144127 | | 8/2008 |
| JP | 3146538 | | 10/2008 |
| JP | 2008-294243 | | 12/2008 |
| JP | 2009-44568 | | 2/2009 |
| JP | 2009-62986 | | 3/2009 |
| JP | D1371413 | | 10/2009 |
| JP | 2009-275925 | | 11/2009 |
| JP | D1376284 | | 12/2009 |
| JP | 2010-46411 | | 3/2010 |
| JP | 2010-131259 | | 6/2010 |
| JP | 2010-203760 | | 9/2010 |
| JP | 2010-203764 | | 9/2010 |
| JP | 2012-31806 | | 2/2012 |
| KR | 1999-002660 | | 1/1999 |
| KR | 10-2005-0102317 | | 10/2005 |
| KR | 2007-0007997 | | 1/2007 |
| KR | 20-0448319 | | 3/2010 |
| KR | 10-2010-0055611 | | 5/2010 |
| KR | 10-0985378 | | 9/2010 |
| TW | 517825 | | 1/2003 |
| TW | 589932 | | 6/2004 |
| TW | M394383 | | 12/2010 |
| TW | M399207 | | 3/2011 |
| TW | M407299 | | 7/2011 |
| WO | WO-90/13478 | | 11/1990 |
| WO | WO-95/06822 | | 3/1995 |
| WO | WO-02/073096 | | 9/2002 |
| WO | WO-03/058795 | | 7/2003 |
| WO | WO-03/069931 | | 8/2003 |
| WO | WO-2005/050026 | | 6/2005 |
| WO | WO-2005/057091 | | 6/2005 |
| WO | WO-2006/008021 | | 1/2006 |
| WO | WO-2006/012526 | | 2/2006 |
| WO | WO-2007/024955 | | 3/2007 |
| WO | WO-2007/048205 | | 5/2007 |
| WO | WO-2008/014641 | | 2/2008 |
| WO | WO-2008/024569 | | 2/2008 |
| WO | WO-2008/139491 | | 11/2008 |
| WO | WO-2009/030879 | | 3/2009 |
| WO | WO-2009/030881 | | 3/2009 |
| WO | WO-2010/100449 | A1 | 9/2010 |
| WO | WO-2010/100451 | | 9/2010 |
| WO | WO-2010/100452 | | 9/2010 |
| WO | WO-2010/100453 | | 9/2010 |
| WO | WO-2010/100462 | | 9/2010 |
| WO | WO-2011/050041 | | 4/2011 |
| WO | WO-2011/147318 | | 12/2011 |
| WO | WO-2012/006882 | A1 | 1/2012 |
| WO | WO-2012/033517 | A1 | 3/2012 |
| WO | WO-2012/052737 | | 4/2012 |
| WO | WO-2013/014419 | A2 | 1/2013 |
| WO | WO-2013/132218 | | 9/2013 |

OTHER PUBLICATIONS

Gammack, P. et al., U.S. Office Action mailed Dec. 9, 2010, directed to U.S. Appl. No. 12/203,698; 10 pages.

Gammack, P. et al., U.S. Office Action mailed Jun. 21,2011, directed to U.S. Appl. No. 12/203,698; 11 pages.

Gammack et al., Office Action mailed Sep. 17, 2012, directed to U.S. Appl. No. 13/114,707; 12 pages.

Gammack, P. et al., U.S. Office Action mailed Dec. 10, 2010, directed to U.S. Appl. No. 12/230,613; 12 pages.

Gammack, P. et al., U.S. Office Action mailed May 13, 2011, directed to U.S. Appl. No. 12/230,613; 13 pages.

Gammack, P. et al., U.S. Office Action mailed Sep. 7, 2011, directed to U.S. Appl. No. 12/230,613; 15 pages.

Gammack, P. et al., U.S. Office Action mailed Jun. 8, 2012, directed to U.S. Appl. No. 12/230,613; 15 pages.

Gammack et al., U.S. Office Action mailed Aug. 20, 2012, directed to U.S. Appl. No. 12/945,558; 15 pages.

(56) References Cited

OTHER PUBLICATIONS

Fitton et al., U.S. Office Action mailed Nov. 30, 2010 directed to U.S. Appl. No. 12/560,232; 9 pages.
Nicolas, F. et al., U.S. Office Action mailed Mar. 7, 2011, directed to U.S. Appl. No. 12/622,844; 10 pages.
Nicolas, F. et al., U.S. Office Action mailed Sep. 8, 2011, directed to U.S. Appl. No. 12/622,844; 11 pages.
Fitton, et al., U.S. Office Action mailed Mar. 8, 2011, directed to U.S. Appl. No. 12/716,780; 12 pages.
Fitton, et al., U.S. Office Action mailed Sep. 6, 2011, directed to U.S. Appl. No. 12/716,780; 16 pages.
Gammack, P. et al., U.S. Office Action mailed Dec. 9, 2010, directed to U.S. Appl. No. 12/716,781; 17 pages.
Gammack, P. et al., U.S. Final Office Action mailed Jun. 24, 2011, directed to U.S. Appl. No. 12/716,781; 19 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed Jun. 25, 2012, directed to U.S. Appl. No. 12/716,749; 11 pages.
Fitton et al., U.S. Office Action mailed Mar. 30, 2012, directed to U.S. Appl. No. 12/716,707; 7 pages.
Gammack, P. et al., U.S. Office Action mailed May 24, 2011, directed to U.S. Appl. No. 12/716,613; 9 pages.
Gammack, P. et al. U.S. Office Action mailed Oct. 18, 2012, directed to U.S. Appl. No. 12/917,247; 11 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Fitton et al., U.S. Office Action mailed Dec. 31, 2013, directed to U.S. Appl. No. 13/718,693; 8 pages.
Helps, D. F. et al., U.S. Office Action mailed Feb. 15, 2013, directed to U.S. Appl. No. 12/716,694; 12 pages.
Search Report dated Feb. 14, 2012, directed towards GB Application No. 1119500.5; 1 page.
Gammack, P. et al., U.S. Office Action mailed Feb. 10, 2014, directed to U.S. Appl. No. 12/716,515; 21 pages.
Gammack et al., U.S. Office Action mailed Feb. 28, 2013, directed to U.S. Appl. No. 12/945,558; 16 pages.
Gammack et al., U.S. Office Action mailed Feb. 14, 2013, directed to U.S. Appl. No. 12/716,515; 21 pages.
Gammack et al., U.S. Office Action mailed Mar. 14, 2013, directed to U.S. Appl. No. 12/716,740; 15 pages.
Li et al., U.S. Office Action mailed Oct. 25, 2013, directed to U.S. Appl. No. 13/686,480; 17 pages.
Gammack et al., U.S. Office Action mailed Apr. 24, 2014, directed to U.S. Appl. No. 12/716,740; 16 pages.
Dos Reis et al., U.S. Office Action mailed Sep. 23, 2014, directed to U.S. Appl. No. 29/466,240; 9 pages.
Dos Reis et al., U.S. Office Action mailed Sep. 24, 2014, directed to U.S. Appl. No. 29/466,229; 9 pages.
Dos Reis et al., U.S. Office Action mailed Sep. 19, 2014, directed to U.S. Appl. No. 29/466,190; 9 pages.
Mcpherson et al., U.S. Office Action mailed Sep. 19, 2014, directed to U.S. Appl. No. 29/466,094; 8 pages.
Mcpherson et al., U.S. Office Action mailed Sep. 19, 2014, directed to U.S. Appl. No. 29/466,241; 8 pages.
Mcpherson et al., U.S. Office Action mailed Sep. 19, 2014, directed to U.S. Appl. No. 29/466,253; 7 pages.
Dyson et al., U.S. Office Action mailed Sep. 12, 2014, directed to U.S. Appl. No. 29/480,896; 10 pages.
Dyson et al., U.S. Office Action mailed Sep. 12, 2014, directed to U.S. Appl. No. 29/480,915; 9 pages.
Poulton et al., U.S. Office Action mailed Sep. 12, 2014, directed to U.S. Appl. No. 29/480,919; 10 pages.
Deniss. (Sep. 9, 2010) "iFan, The Chinese Clone of the Dyson Air Multiplier," located at <http://chinitech.com/en/chinese-clones/ifan-le-clone-chinois-du-dyson-air-multiplier> visited on Aug. 29, 2014. (6 pages).
Amee. (Mar. 29, 2012) "Breeze Right Bladeless Fan Up to 41% Off," located at <http://madamedeals.com/breeze-right-bladeless-fan-up-to-41-off/> visited on Sep. 3, 2014. (2 pages).
Questel. (Jun. 11, 2014) "Designs-Questel" located at <http://sobjprd.questel.fr/export/QPTUJ214/pdf2/19f053ea-a60f-4c58-9232-c458147a9adf-224304.pdf/> visited on Sep. 4, 2014. (67 pages).
Amazon. "Pisenic Bladeless Fan 16 Inches with Remote Control, Bladeless Fan Air Conditioner 110v, Air Multiplier Table Fans, Green," located at <http://www.amazon.com/Pisenic-Bladeless-Fan-16-Conditioner/dp/B007VCI78M%3FSubscriptionid%3DAKIAJYLII7AAJMX7ETAA%26tag%3Dtk78-20%26linkCode%3Dxm2%26camp%3D2025%26creative%3D165953%26creativeASIN%3DB007VCI78M#cm_cr_dpwidget> visited on Sep. 2, 2014. (4 pages).
Steiner, L., (May 14, 2013) "Dyson Fan Heater Review: Cozy Up to Dyson Fan Heater," located at <http://www.vissbiz.com/dyson-fan-heater-review/cozy-up-to-dyson-fan-heater/> visited on Sep. 3, 2014. (3 pages).
Fitton et al., U.S. Office Action mailed Jun. 13, 2014, directed to U.S. Appl. No. 13/274,998; 11 pages.
Fitton et al., U.S. Office Action mailed Jun. 13, 2014, directed to U.S. Appl. No. 13/275,034; 10 pages.
Gammack et al., U.S. Office Action mailed Sep. 3, 2014, directed to U.S. Appl. No. 13/861,891; 7 pages.
Staniforth et al., U.S. Office Action mailed Sep. 18, 2014, directed to U.S. Appl. No. 13/559,142; 18 pages.
Gammack, P. et al., Office Action mailed Aug. 19, 2013, directed to U.S. Appl. No. 12/716,515; 20 pages.
International Search Report and Written Opinion mailed Sep. 19, 2013, directed to International Application No. PCT/GB2012/052742; 10 pages.
Gammack et al., U.S. Office Action mailed Sep. 6, 2013, directed to U.S. Appl. No. 12/716,740; 15 pages.
Gammack et al., Office Action mailed Sep. 27, 2013, directed to U.S. Appl. No. 13/588,666; 10 pages.
Wallace et al., Office Action mailed Oct. 23, 2013, directed to U.S. Appl. No. 13/192,223; 18 pages.
Gammack et al., Office Action mailed Jun. 12, 2013, directed towards U.S. Appl. No. 12/945,558; 20 pages.
Gammack et al., Office Action mailed May 29, 2013, directed towards U.S. Appl. No. 13/588,666; 11 pages.
Wallace et al., Office Action mailed Jun. 7, 2013, directed towards U.S. Appl. No. 13/192,223; 30 pages.

* cited by examiner

FAN ASSEMBLY

REFERENCE TO RELATED APPLICATIONS

This application claims the priority of United Kingdom Application No. 1119500.5, filed Nov. 11, 2011, and United Kingdom Application No. 1205576.0, filed Mar. 29, 2012, the entire contents of which are incorporated herein by reference.

FIELD OF THE INVENTION

The present invention relates to a nozzle for a fan assembly, and a fan assembly comprising such a nozzle.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows an air flow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an air flow into the base, and a series of concentric, annular nozzles connected to the base and each comprising an annular outlet located at the front of the nozzle for emitting the air flow from the fan. Each nozzle extends about a bore axis to define a bore about which the nozzle extends.

Each nozzle is in the shape of an airfoil. An airfoil may be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the air flow in a direction extending away from the nozzle and along the chord line.

Another fan assembly which does not use caged blades to project air from the fan assembly is described in WO 2010/100451. This fan assembly comprises a cylindrical base which also houses a motor-driven impeller for drawing a primary air flow into the base, and a single annular nozzle connected to the base and comprising an annular mouth through which the primary air flow is emitted from the fan. The nozzle defines an opening through which air in the local environment of the fan assembly is drawn by the primary air flow emitted from the mouth, amplifying the primary air flow. The nozzle includes a Coanda surface over which the mouth is arranged to direct the primary air flow. The Coanda surface extends symmetrically about the central axis of the opening so that the air flow generated by the fan assembly is in the form of an annular jet having a cylindrical or frusto-conical profile.

SUMMARY OF THE INVENTION

In a first aspect, the present invention provides a nozzle for a fan assembly, the nozzle comprising an air inlet, at least one air outlet, an annular inner wall at least partially defining a bore through which air from outside the nozzle is drawn by air emitted from said at least one air outlet, an outer wall extending about a longitudinal axis and about the inner wall, and an interior passage located between the inner wall and the outer wall for conveying air from the air inlet to said at least one air outlet, wherein the interior passage has a first section and a second section each for receiving a respective portion of an air flow entering the interior passage through the air inlet, and for conveying the portions of the air flow in opposite angular directions about the bore, and wherein each section of the interior passage has a cross-sectional area formed from the intersection with the interior passage by a plane which extends through and contains the longitudinal axis of the outer wall, and wherein the cross-sectional area of each section of the interior passage decreases in size about the bore.

The air emitted from the nozzle, hereafter referred to as a primary air flow, entrains air surrounding the nozzle, which thus acts as an air amplifier to supply both the primary air flow and the entrained air to the user. The entrained air will be referred to here as a secondary air flow. The secondary air flow is drawn from the room space, region or external environment surrounding the nozzle. The primary air flow combines with the entrained secondary air flow to form a combined, or total, air flow projected forward from the front of the nozzle.

We have found that controlling the cross-sectional area of each section of the nozzle in this manner can reduce turbulence in the combined air flow which is experienced by a user located in front of the nozzle. The reduction in turbulence is a result of minimising the variation in the angle at which the primary air flow is emitted from around the bore of the nozzle. Without this variation in the cross-sectional area, there is a tendency for the primary air flow to be emitted upwardly at a relatively steep angle, relative to the longitudinal axis of the nozzle, from the portion of the interior passage located adjacent to the air inlet, whereas the portion of the air flow emitted from the portion of the interior passage located opposite to the air inlet is emitted at a relatively shallow angle. When the air inlet is located towards the base of the nozzle, this can result in the primary air flow being focussed towards a position located generally in front of an upper end of the nozzle. This convergence of the primary air flow can generate turbulence in the combined air flow generated by the nozzle.

The relative increase in the cross-sectional area of the interior passage adjacent to the air inlet can reduce the velocity at which the primary air flow is emitted from the base of the nozzle. This velocity reduction has been found to reduce the angle at which the air flow is emitted from this portion of the interior passage. Through controlling the shape of the interior passage so that there is a reduction in its cross-sectional area about the bore, any variation in the angle at which the primary air flow is emitted from the nozzle can be significantly reduced.

The variation in the cross-sectional area of each section of the interior passage is seen from the intersection with the interior passage by a series of planes which each extend through and contain the longitudinal axis of the outer wall, upon which the outer wall is centred. The variation in the cross-sectional area of each section of the interior passage may also be referred to as a variation in the cross-sectional area of an air flow path which extends from a first end to a second end of the section of the interior passage, and so this aspect of the present invention also provides a nozzle for a fan assembly, the nozzle comprising an air inlet; at least one air outlet; an annular inner wall at least partially defining a bore through which air from outside the nozzle is drawn by air emitted from said at least one air outlet; an outer wall extending about a longitudinal axis and about the inner wall; and an interior passage located between the inner wall and the outer wall for conveying air from the air inlet to said at least one air outlet; wherein the interior passage has a first section and a second section each for receiving a respective portion of an air flow entering the interior passage through the air inlet, and for conveying the portions of the air flow in opposite angular directions about the bore; along a flow path extending from a first end to a second end of the section; and wherein the cross-sectional area of the flow path decreases in size about the bore.

The cross-sectional area of each section of the interior passage may decrease step-wise about the bore. Alternatively, the cross-sectional area of each section of the interior passage may decrease gradually, or taper, about the bore.

The nozzle is preferably substantially symmetrical about a plane passing through the air inlet and the centre of the nozzle, and so each section of the interior passage preferably has the same variation in cross-sectional area. For example, the nozzle may have a generally circular, elliptical or "racetrack" shape, in which each section of the interior passage comprises a relatively straight section located on a respective side of the bore.

The variation in the cross-sectional area of each section of the interior passage is preferably such that the cross-sectional area decreases in size about the bore from a first end for receiving air from the air inlet to a second end. The cross-sectional area of each section preferably has a minimum value located diametrically opposite the air inlet.

The variation in the cross-sectional area of each section of the interior passage is preferably such that the cross-sectional area has a first value adjacent the air inlet and a second value opposite to the air inlet, and where the first value is at least 1.5 times the second value, and more preferably so that the first value is at least 1.8 times the second value.

The variation in the cross-sectional area of each section of the interior passage may be effected by varying about the bore the radial thickness of each section of the nozzle. In this case, the depth of the nozzle, as measured in a direction extending along the axis of the bore, may be substantially constant about the bore. Alternatively, the depth of the nozzle may also vary about the bore. For example, the depth of each section of the nozzle may decrease from a first value adjacent the air inlet to a second value opposite to the air inlet.

The air inlet may comprise a plurality of sections or apertures through which air enters the interior passage of the nozzle. These sections or apertures may be located adjacent one another, or spaced about the nozzle. The at least one air outlet may be located at or towards the front end of the nozzle. Alternatively, the at least one air outlet may be located towards the rear end of the nozzle. The nozzle may comprise a single air outlet or a plurality of air outlets. In one example, the nozzle comprises a single, annular air outlet surrounding the axis of the bore, and this air outlet may be circular in shape, or otherwise have a shape which matches the shape of the front end of the nozzle. Alternatively, each section of the interior passage may comprise a respective air outlet. For example, where the nozzle has a race track shape each straight section of the nozzle may comprise a respective air outlet. The, or each, air outlet is preferably in the form of a slot. The slot preferably has a width in the range from 0.5 to 5 mm.

The inner wall preferably defines at least a front part of the bore. Each wall may be formed from a single component, but alternatively one or both of the walls may be formed from a plurality of components. The inner wall is preferably eccentric with respect to the outer wall. In other words, the inner wall and the outer wall are preferably not concentric. In one example, the centre, or longitudinal axis, of the inner wall is located above the centre, or longitudinal axis, of the outer wall so that the cross-sectional area of the internal passage decreases from the lower end of the nozzle towards the upper end of the nozzle. This can be a relatively straightforward way of effecting the variation of the cross-section of the nozzle, and so in a second aspect the present invention provides a nozzle for a fan assembly, the nozzle comprising an air inlet, at least one air outlet, an interior passage for conveying air from the air inlet to said at least one air outlet, an annular inner wall, and an outer wall extending about the inner wall, the interior passage being located between the inner wall and the outer wall, the inner wall at least partially defining a bore through which air from outside the nozzle is drawn by air emitted from said at least one air outlet, wherein the inner wall is eccentric with respect to the outer wall.

As discussed above, the cross-sectional area of each section of the nozzle is preferably measured in a series of intersecting planes which each pass through the centre of the outer wall of the nozzle and each contain a longitudinal axis passing through the centre of the outer wall. However, due to the eccentricity of the inner and outer walls the cross-sectional area of each section of the nozzle may be measured in a series of intersecting planes which each pass through the centre of the inner wall of the nozzle and each contain a longitudinal axis passing through the centre of the inner wall. This axis is co-linear with the axis of the bore.

The at least one air outlet is preferably located between the inner wall and the outer wall. For example, the at least one air outlet may be located between overlapping portions of the inner wall and the outer wall. These overlapping portions of the walls may comprise part of an internal surface of the inner wall, and part of an external surface of the outer wall. Alternatively, these overlapping portions of the walls may comprise part of an internal surface of the outer wall, and part of an external surface of the inner wall. A series of spacers may be angularly spaced about one of these parts of the walls for engaging the other wall to control the width of the at least one air outlet. The overlapping portions of the walls are preferably substantially parallel, and so serve to guide the air flow emitted from the nozzle in a selected direction. In one example, the overlapping portions are frusto-conical in shape so that they are inclined relative to the axis of the bore. Depending on the desired profile of the air flow emitted from the nozzle, the overlapping portions may be inclined towards or away from the axis of the bore.

Without wishing to be bound by any theory, we consider that the rate of entrainment of the secondary air flow by the primary air flow may be related to the magnitude of the surface area of the outer profile of the primary air flow emitted from the nozzle. When the primary air flow is outwardly tapering, or flared, the surface area of the outer profile is relatively high, promoting mixing of the primary air flow and the air surrounding the nozzle and thus increasing the flow rate of the combined air flow, whereas when the primary air flow is inwardly tapering, the surface area of the outer profile is relatively low, decreasing the entrainment of the secondary air flow by the primary air flow and so decreasing the flow rate of the combined air flow.

Increasing the flow rate of the combined air flow generated by the nozzle has the effect of decreasing the maximum velocity of the combined air flow. This can make the nozzle suitable for use with a fan assembly for generating a flow of air through a room or an office. On the other hand, decreasing the flow rate of the combined air flow generated by the nozzle has the effect of increasing the maximum velocity of the combined air flow. This can make the nozzle suitable for use with a desk fan or other table-top fan for generating a flow of air for cooling rapidly a user located in front of the fan.

The nozzle may have an annular front wall extending between the inner wall and the outer wall. To reduce the number of components of the nozzle, the front wall is preferably integral with the outer wall. The at least one air outlet may be located adjacent the front wall, for example between the bore and the front wall.

Alternatively, the at least one air outlet may be configured to direct air over the external surface of the inner wall. At least part of the external surface located adjacent to the at least one air outlet may be convex in shape, and provide a Coanda surface over which air emitted from the nozzle is directed.

The air inlet is preferably defined by the outer wall of the nozzle, and is preferably located at the lower end of the nozzle.

The present invention also provides a fan assembly comprising an impeller, a motor for rotating the impeller to generate an air flow, and a nozzle as aforementioned for receiving the air flow. The nozzle is preferably mounted on a base housing the impeller and the motor.

Features described above in connection with the first aspect of the invention are equally applicable to the second aspect of the invention, and vice versa.

BRIEF DESCRIPTION OF THE INVENTION

An embodiment of the present invention will now be described, by way of example only, with reference to the accompanying drawings, in which:

FIG. 3(*b*) is a cross-sectional view through one section of the nozzle of the fan assembly, taken along line A-A in FIG. 2;

FIG. 3(*c*) is a cross-sectional view through one section of the nozzle of the fan assembly, taken along line B-B in FIG. 2;

FIG. 3(*d*) is a cross-sectional view through one section of the nozzle of the fan assembly, taken along line C-C in FIG. 2.

FIG. 6(*b*) is a cross-sectional view through one section of the nozzle of the fan assembly, taken along line A-A in FIG. 5;

FIG. 6(*c*) is a cross-sectional view through one section of the nozzle of the fan assembly, taken along line B-B in FIG. 5; and FIG. 6(*d*) is a cross-sectional view through one section of the nozzle of the fan assembly, taken along line C-C in FIG. 5.

DETAILED DESCRIPTION OF THE INVENTION

Figure 1:
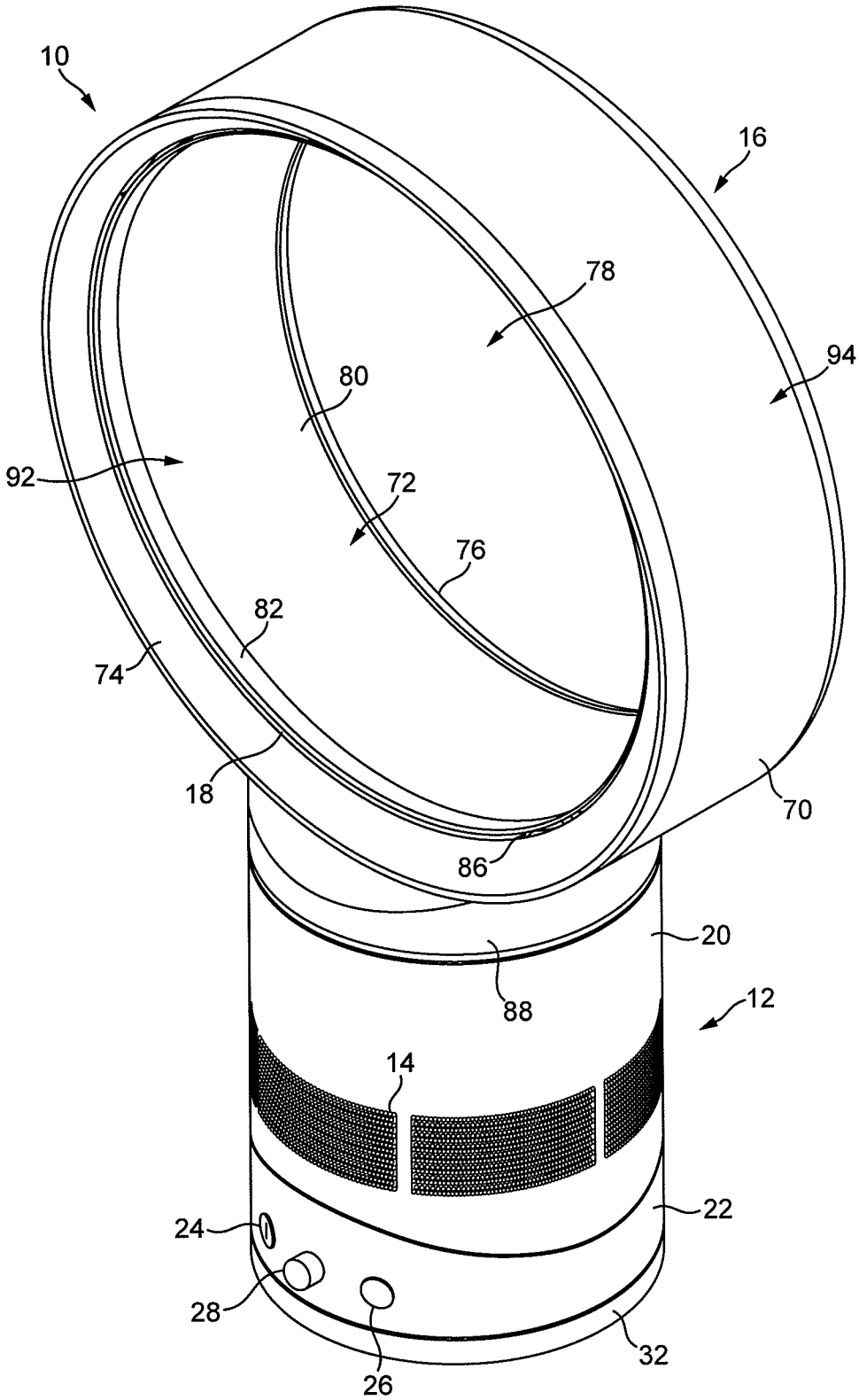
FIG. 1 is a front perspective view, from above, of a first embodiment of a fan assembly.
Figure 2:
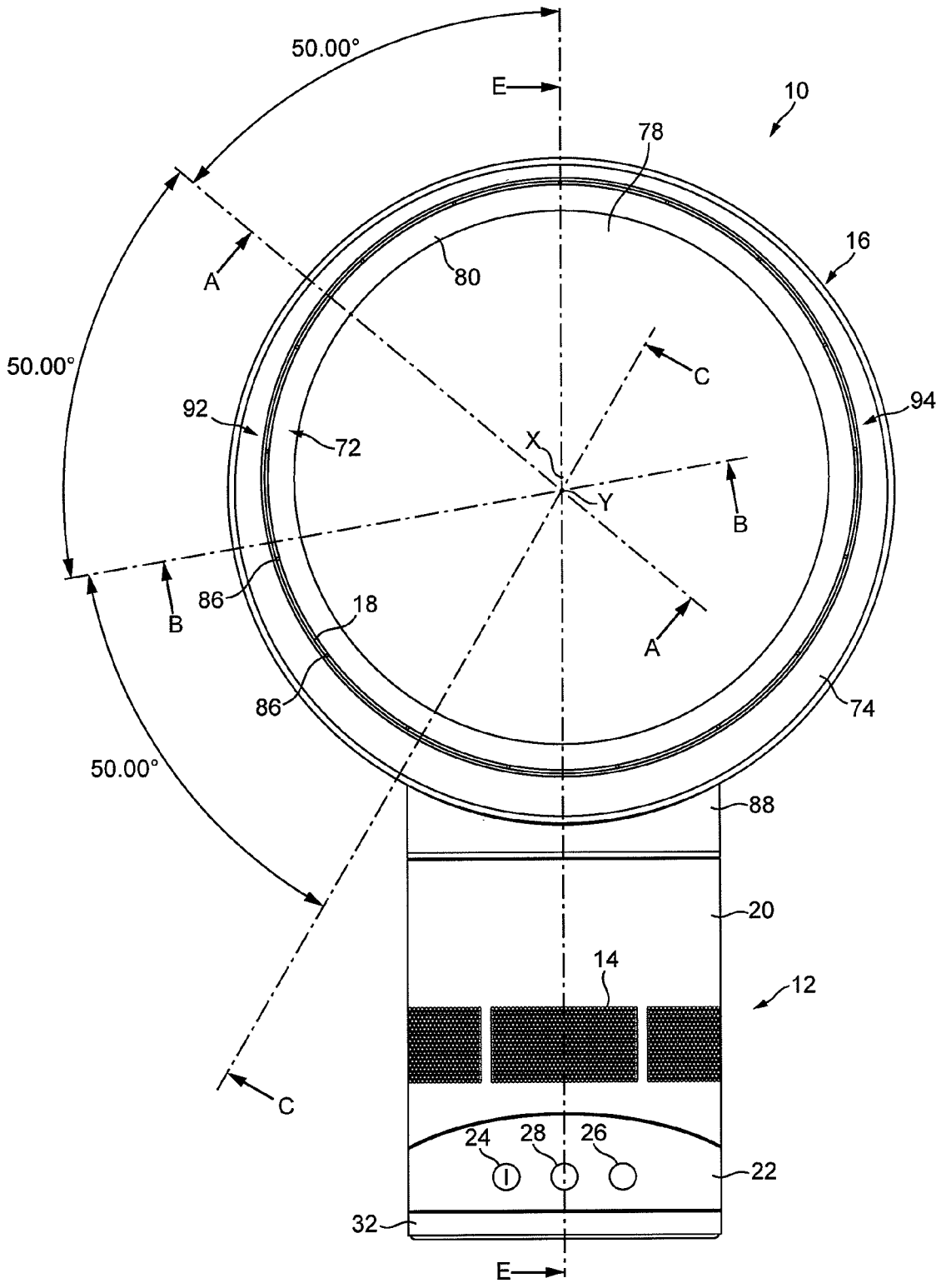
FIG. 2 is a front view of the fan assembly.

FIGS. 1 and 2 are external views of a first embodiment of a fan assembly 10. The fan assembly 10 comprises a body 12 comprising an air inlet 14 through which a primary air flow enters the fan assembly 10, and an annular nozzle 16 mounted on the body 12. The nozzle 16 comprises an air outlet 18 for emitting the primary air flow from the fan assembly 10.

The body 12 comprises a substantially cylindrical main body section 20 mounted on a substantially cylindrical lower body section 22. The main body section 20 and the lower body section 22 preferably have substantially the same external diameter so that the external surface of the upper body section 20 is substantially flush with the external surface of the lower body section 22. In this embodiment the body 12 has a height in the range from 100 to 300 mm, and a diameter in the range from 100 to 200 mm.

The main body section 20 comprises the air inlet 14 through which the primary air flow enters the fan assembly 10. In this embodiment the air inlet 14 comprises an array of apertures formed in the main body section 20. Alternatively, the air inlet 14 may comprise one or more grilles or meshes mounted within windows formed in the main body section 20. The main body section 20 is open at the upper end (as illustrated) thereof to provide an air outlet 23 (shown in FIG. 3(*a*)) through which the primary air flow is exhausted from the body 12.

The main body section 20 may be tilted relative to the lower body section 22 to adjust the direction in which the primary air flow is emitted from the fan assembly 10. For example, the upper surface of the lower body section 22 and the lower surface of the main body section 20 may be provided with interconnecting features which allow the main body section 20 to move relative to the lower body section 22 while preventing the main body section 20 from being lifted from the lower body section 22. For example, the lower body section 22 and the main body section 20 may comprise interlocking L-shaped members.

The lower body section 22 comprises a user interface of the fan assembly 10. The user interface comprises a plurality of user-operable buttons 24, 26, a dial 28 for enabling a user to control various functions of the fan assembly 10, and a user interface control circuit 30 connected to the buttons 24, 26 and the dial 28. The lower body section 22 is mounted on a base 32 for engaging a surface on which the fan assembly 10 is located.

Figure 3:
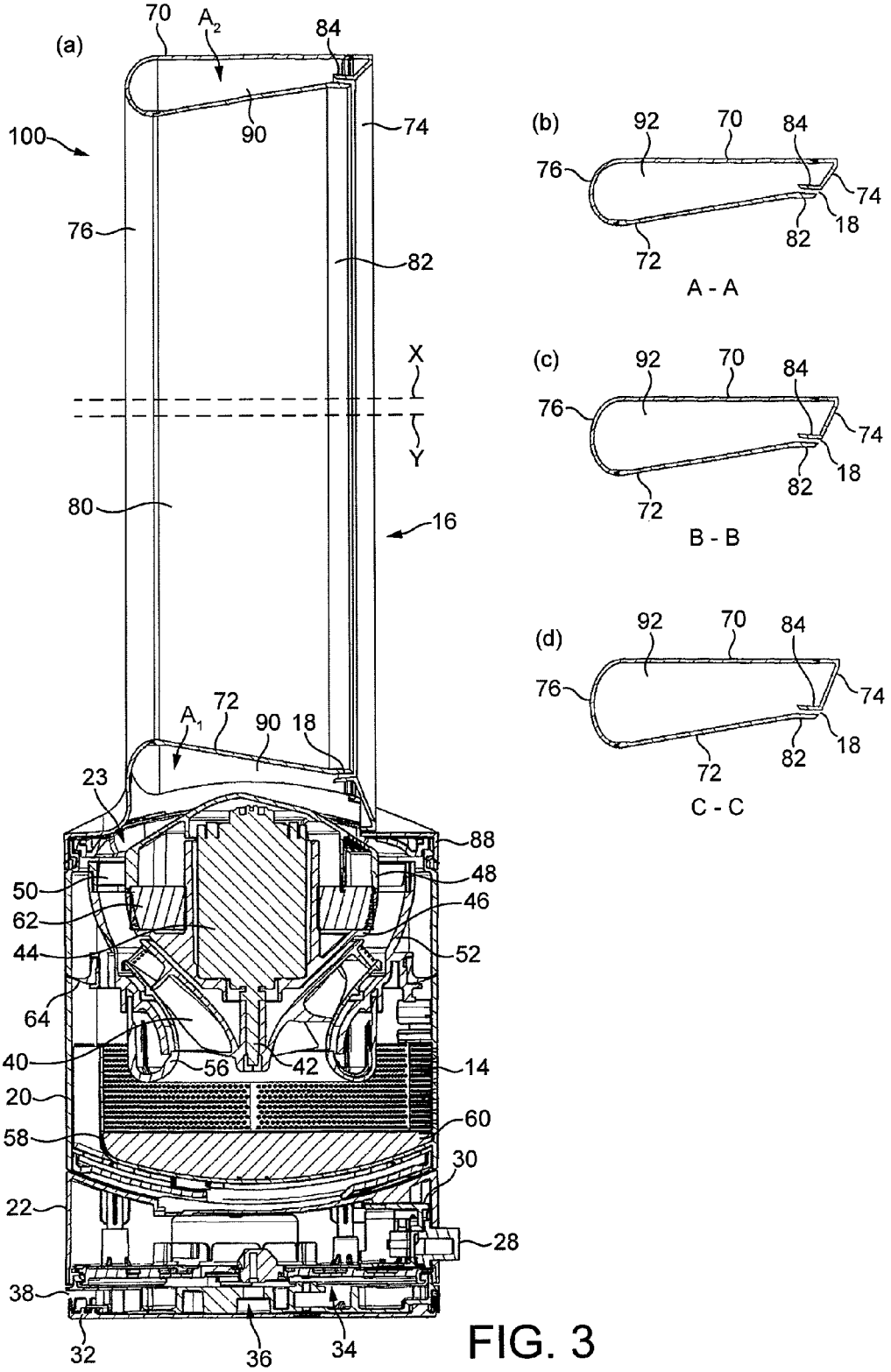
FIG. 3(*a*) is a left side cross-section view, taken along line E-E in FIG. 2.

FIG. 3(*a*) illustrates a sectional view through the fan assembly 10. The lower body section 22 houses a main control circuit, indicated generally at 34, connected to the user interface control circuit 30. In response to operation of the buttons 24, 26 and the dial 28, the user interface control circuit 30 is arranged to transmit appropriate signals to the main control circuit 34 to control various operations of the fan assembly 10.

The lower body section 22 also houses a mechanism, indicated generally at 36, for oscillating the lower body section 22 relative to the base 32. The operation of the oscillating mechanism 36 is controlled by the main control circuit 34 in response to the user operation of the button 26. The range of each oscillation cycle of the lower body section 22 relative to the base 32 is preferably between 60° and 120°, and in this embodiment is around 80°. In this embodiment, the oscillating mechanism 36 is arranged to perform around 3 to 5 oscillation cycles per minute. A mains power cable (not shown) for supplying electrical power to the fan assembly 10 extends through an aperture 38 formed in the base 32. The cable is connected to a plug for connection to a mains power supply.

The main body section 20 houses an impeller 40 for drawing the primary air flow through the air inlet 14 and into the body 12. Preferably, the impeller 40 is in the form of a mixed flow impeller. The impeller 40 is connected to a rotary shaft 42 extending outwardly from a motor 44. In this embodiment, the motor 44 is a DC brushless motor having a speed which is variable by the main control circuit 34 in response to user manipulation of the dial 28. The maximum speed of the motor 44 is preferably in the range from 5,000 to 10,000 rpm. The motor 44 is housed within a motor bucket comprising an upper portion 46 connected to a lower portion 48. The upper portion 46 of the motor bucket comprises a diffuser 50 in the form of an annular disc having curved blades.

The motor bucket is located within, and mounted on, a generally frusto-conical impeller housing 52. The impeller housing 52 is, in turn, mounted on a plurality of angularly spaced supports 54, in this example three supports, located within and connected to the main body section 20 of the base 12. The impeller 40 and the impeller housing 52 are shaped so that the impeller 40 is in close proximity to, but does not contact, the inner surface of the impeller housing 52. A substantially annular inlet member 56 is connected to the bottom of the impeller housing 52 for guiding the primary air flow into the impeller housing 52. An electrical cable 58 passes from the main control circuit 34 to the motor 44 through apertures formed in the main body section 20 and the lower body section 22 of the body 12, and in the impeller housing 52 and the motor bucket.

Preferably, the body 12 includes silencing foam for reducing noise emissions from the body 12. In this embodiment, the main body section 20 of the body 12 comprises a first foam member 60 located beneath the air inlet 14, and a second annular foam member 62 located within the motor bucket.

A flexible sealing member 64 is mounted on the impeller housing 52. The flexible sealing member prevents air from passing around the outer surface of the impeller housing 52 to the inlet member 56. The sealing member 64 preferably comprises an annular lip seal, preferably formed from rubber. The sealing member 64 further comprises a guide portion in the form of a grommet for guiding the electrical cable 58 to the motor 44.

Returning to FIGS. 1 and 2, the nozzle 16 has an annular shape. The nozzle 16 comprises an outer wall 70 extending about an annular inner wall 72. In this example, each of the walls 70, 72 is formed from a separate component. The nozzle 16 also has a front wall 74 and a rear wall 76, which in this example are integral with the outer wall 70. A rear end of the inner wall 72 is connected to the rear wall 76, for example using an adhesive.

The inner wall 72 extends about a bore axis, or longitudinal axis, X to define a bore 78 of the nozzle 16. The bore 78 has a generally circular cross-section which varies in diameter along the bore axis X from the rear wall 76 of the nozzle 16 to the front wall 74 of the nozzle 16. In this example, the inner wall 72 has an annular rear section 80 and an annular front section 82 which each extend about the bore 78. The rear section 80 has a frusto-conical shape, and tapers outwardly from the rear wall 76 away from the bore axis X. The front section 82 also has a frusto-conical shape, but tapers inwardly towards the bore axis X. The angle of inclination of the front section 82 relative to the bore axis X is preferably in the range from −20 to 20°, and in this example is around 8°.

As mentioned above, the front wall 74 and the rear wall 76 of the nozzle 16 may be integral with the outer wall 70. The end section 84 of the outer wall 70 which is located adjacent to the inner wall 72 is shaped to extend about, or overlap, the front section 82 of the inner wall 72 to define the air outlet 18 of the nozzle 16 between the outer surface of the outer wall 70 and the inner surface of the inner wall 72. The end section 84 of the outer wall 70 is substantially parallel to the front section 82 of the inner wall 72, and so also tapers inwardly towards the bore axis X at an angle of around 8°. The air outlet 18 of the nozzle 16 is thus located between the walls 70, 72 of the nozzle 16, and is located towards the front end of the nozzle 16. The air outlet 18 is in the form of a generally circular slot centred on, and extending about, the bore axis X. The width of the slot is preferably substantially constant about the bore axis X, and is in the range from 0.5 to 5 mm. A series of angularly spaced spacers 86 may be provided on one of the facing surfaces of the sections 82, 84 to engage the other facing surface to maintain a regular spacing between these facing surfaces. For example, the inner wall 72 may be connected to the outer wall 70 so that, in the absence of the spacers 86, the facing surfaces would make contact, and so the spacers 86 also serve to urge the facing surfaces apart.

The outer wall 70 comprises a base 88 which is connected to the open upper end 23 of the main body section 20 of the body 12, and which has an open lower end which provides an air inlet for receiving the primary air flow from the body 12. The remainder of the outer wall 70 is generally cylindrical shape, and extends about a central axis, or longitudinal axis, Y which is parallel to, but spaced from, the bore axis X. In other words, the outer wall 70 and the inner wall 72 are eccentric. In this example, the bore axis X is located above the central axis Y, with each of the axes X, Y being located in a plane E-E, illustrated in FIG. 2, which extends vertically through the centre of the fan assembly 10.

The outer wall 70 and the inner wall 72 define an interior passage 90 for conveying air from the air inlet 88 to the air outlet 18. The interior passage 90 extends about the bore 78 of the nozzle 16. In view of the eccentricity of the walls 70, 72 of the nozzle 16, the cross-sectional area of the interior passage 90 varies about the bore 78. The interior passage 90 may be considered to comprise first and second curved sections, indicated generally at 92 and 94 in FIGS. 1 and 2, which each extend in opposite angular directions about the bore 78. With reference also to FIGS. 3(*a*) to 3(*d*), each section 92, 94 of the interior passage 90 has a cross-sectional area which decreases in size about the bore 78. The cross-sectional area of each section 92, 94 decreases from a first value $A_1$ located adjacent the air inlet of the nozzle 16 to a second value $A_2$ located diametrically opposite the air inlet, and where the two sections 92, 94 are joined. The relative positions of the axes X, Y are such that each section 92, 94 of the interior passage 90 has the same variation in cross-sectional area about the bore 78, with the cross-sectional area of each section 92, 94 decreasing gradually from the first value $A_1$ to the second value $A_2$. The variation in the cross-sectional area of the interior passage 90 is preferably such that $A_1 \geq 1.5A_2$, and more preferably such that $A_1 \geq 1.8A_2$. As shown in FIGS. 3(*b*) to 3(*d*), the variation in the cross-sectional area of each section 92, 94 is effected by a variation in the radial thickness of each section 92, 94 about the bore 78; the depth of the nozzle 16, as measured in a direction extending along the axes X, Y is relatively constant about the bore 78. In one example, $A_1 \approx 2500\ mm^2$ and $A_2 \approx 1300\ mm^2$. In another example, $A_1 \approx 1800\ mm^2$ and $A_2 \approx 800\ mm^2$.

To operate the fan assembly 10 the user presses button 24 of the user interface. The user interface control circuit 30 communicates this action to the main control circuit 34, in response to which the main control circuit 34 activates the motor 44 to rotate the impeller 40. The rotation of the impeller 40 causes a primary air flow to be drawn into the body 12 through the air inlet 14. The user may control the speed of the motor 44, and therefore the rate at which air is drawn into the body 12 through the air inlet 14, by manipulating the dial 28 of the user interface. Depending on the speed of the motor 44, the primary air flow generated by the impeller 40 may be between 10 and 30 liters per second. The primary air flow passes sequentially through the impeller housing 52 and the air outlet 23 at the open upper end of the main body portion 20 to enter the interior passage 90 of the nozzle 16 via the air inlet located in the base 88 of the nozzle 16.

Within the interior passage 90, the primary air flow is divided into two air streams which pass in opposite angular directions around the bore 78 of the nozzle 16, each within a respective section 92, 94 of the interior passage 90. As the air streams pass through the interior passage 90, air is emitted through the air outlet 18. The emission of the primary air flow from the air outlet 18 causes a secondary air flow to be generated by the entrainment of air from the external environment, specifically from the region around the nozzle 16. This secondary air flow combines with the primary air flow to produce a combined, or total, air flow, or air current, projected forward from the nozzle 16.

The increase in the cross-sectional area of the interior passage 90 adjacent to the air inlet can reduce the velocity at which the primary air flow is emitted from the lower end of the nozzle 16, which in turn can reduce the angle, relative to the bore axis X, at which the air flow is emitted from this portion of the interior passage 90. The gradual reduction about the bore 78 in the cross-sectional area of each section 92, 94 of the interior passage 90 can have the effect of minimising any variation in the angle at which the primary air flow is emitted from the nozzle 16. The variation in the cross-sectional area of the interior passage 90 about the bore 78 thus reduces turbulence in the combined air flow experienced by the user.

Figure 4:
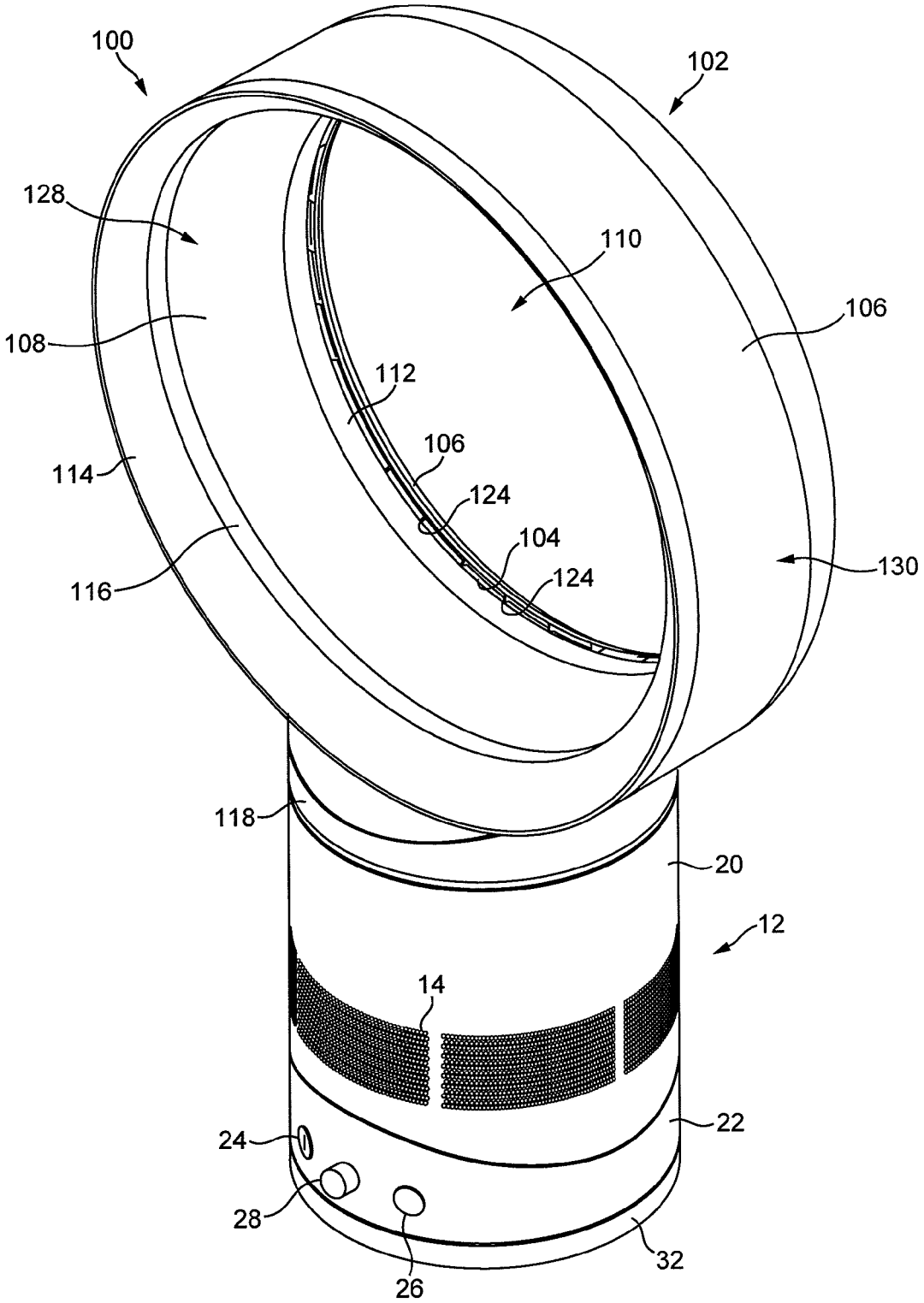
FIG. 4 is a front perspective view, from above, of a second embodiment of a fan assembly.
Figure 5:
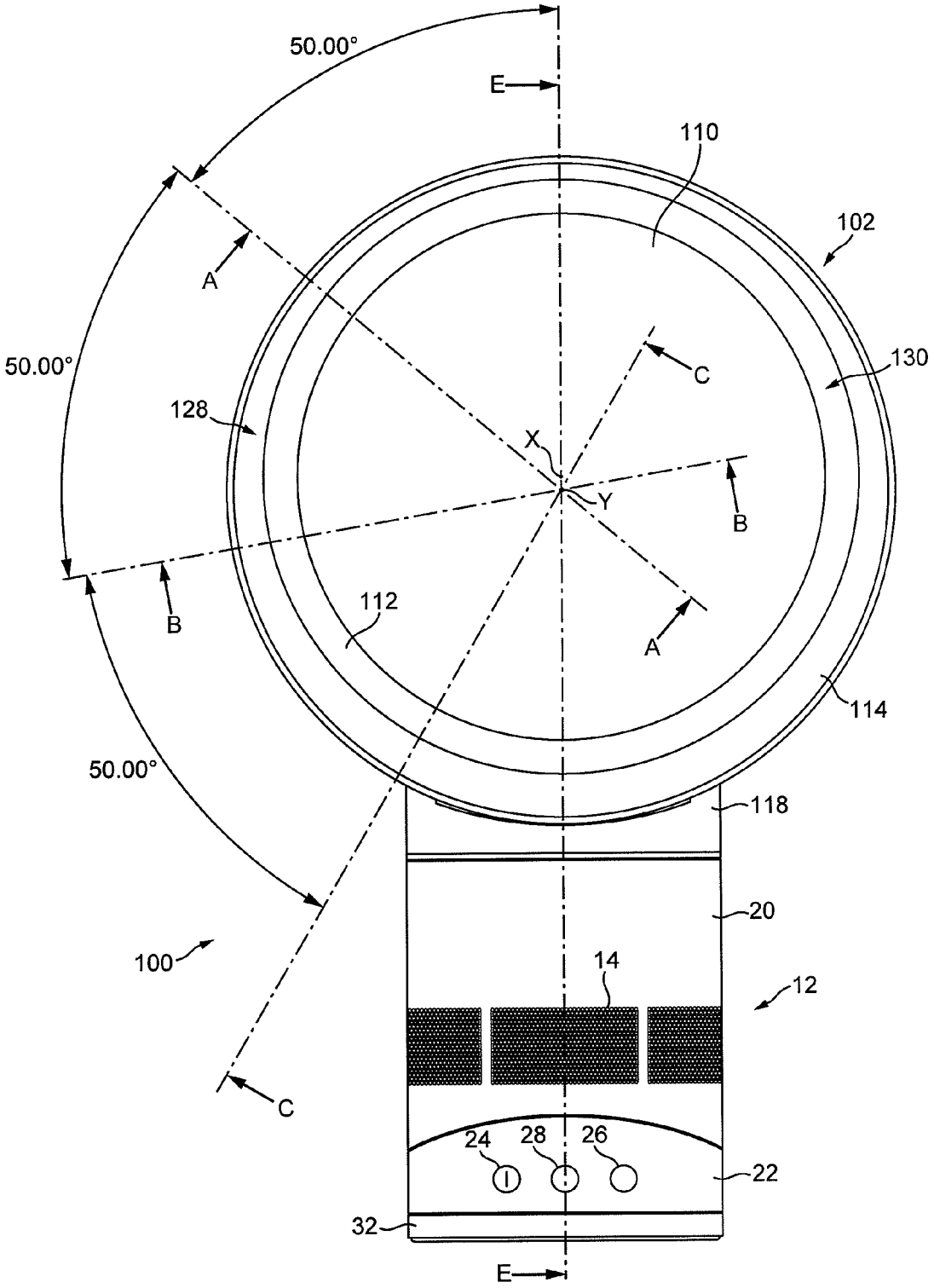
FIG. 5 is a front view of the fan assembly of FIG. 4.

FIGS. 4 and 5 are external views of a second embodiment of a fan assembly 100. The fan assembly 100 comprises a body 12 comprising an air inlet 14 through which a primary air flow enters the fan assembly 10, and an annular nozzle 102 mounted on the body 12. The nozzle 102 comprises an air outlet 104 for emitting the primary air flow from the fan assembly 100. The body 12 is the same as the body 12 of the fan assembly 10, and so will not be described again in detail here.

The nozzle 102 has an annular shape. The nozzle 102 comprises an outer wall 106 extending about an annular inner wall 108. In this example, each of the walls 106, 108 is formed from a separate component. Each of the walls 106, 108 has a front end and a rear end. The rear end of the outer wall 106 curves inwardly towards the rear end of the inner wall 108 to define a rear end of the nozzle 102. The front end of the inner wall 108 is folded outwardly towards the front end of the outer wall 106 to define a front end of the nozzle 102. The front end of the outer wall 106 is inserted into a slot located at the front end of the inner wall 108, and is connected to the inner wall 108 using an adhesive introduced to the slot.

The inner wall 108 extends about a bore axis, or longitudinal axis, X to define a bore 110 of the nozzle 102. The bore 110 has a generally circular cross-section which varies in diameter along the bore axis X from the rear end of the nozzle 102 to the front end of the nozzle 102.

The inner wall 108 is shaped so that the external surface of the inner wall 108, that is, the surface that defines the bore 110, has a number of sections. The external surface of the inner wall 108 has a convex rear section 112, an outwardly flared frusto-conical front section 114 and a cylindrical section 116 located between the rear section 112 and the front section 114.

The outer wall 106 comprises a base 118 which is connected to the open upper end 23 of the main body section 20 of the body 12, and which has an open lower end which provides an air inlet for receiving the primary air flow from the body 12. The majority of the outer wall 106 is generally cylindrical shape. The outer wall 106 extends about a central axis, or longitudinal axis, Y which is parallel to, but spaced from, the bore axis X. In other words, the outer wall 106 and the inner wall 108 are eccentric. In this example, the bore axis X is located above the central axis Y, with each of the axes X, Y being located in a plane E-E, illustrated in FIG. 5, which extends vertically through the centre of the fan assembly 100.

The rear end of the outer wall 106 is shaped to overlap the rear end of the inner wall 108 to define the air outlet 104 of the nozzle 102 between the inner surface of the outer wall 106 and the outer surface of the inner wall 108. The air outlet 104 is in the form of a generally circular slot centred on, and extending about, the bore axis X. The width of the slot is preferably substantially constant about the bore axis X, and is in the range from 0.5 to 5 mm. The overlapping portions 120, 122 of the outer wall 106 and the inner wall 108 are substantially parallel, and are arranged to direct air over the convex rear section 112 of the inner wall 108, which provides a Coanda surface of the nozzle 102. A series of angularly spaced spacers 124 may be provided on one of the facing surfaces of the overlapping portions 120, 122 of the outer wall 106 and the inner wall 108 to engage the other facing surface to maintain a regular spacing between these facing surfaces.

Figure 6:
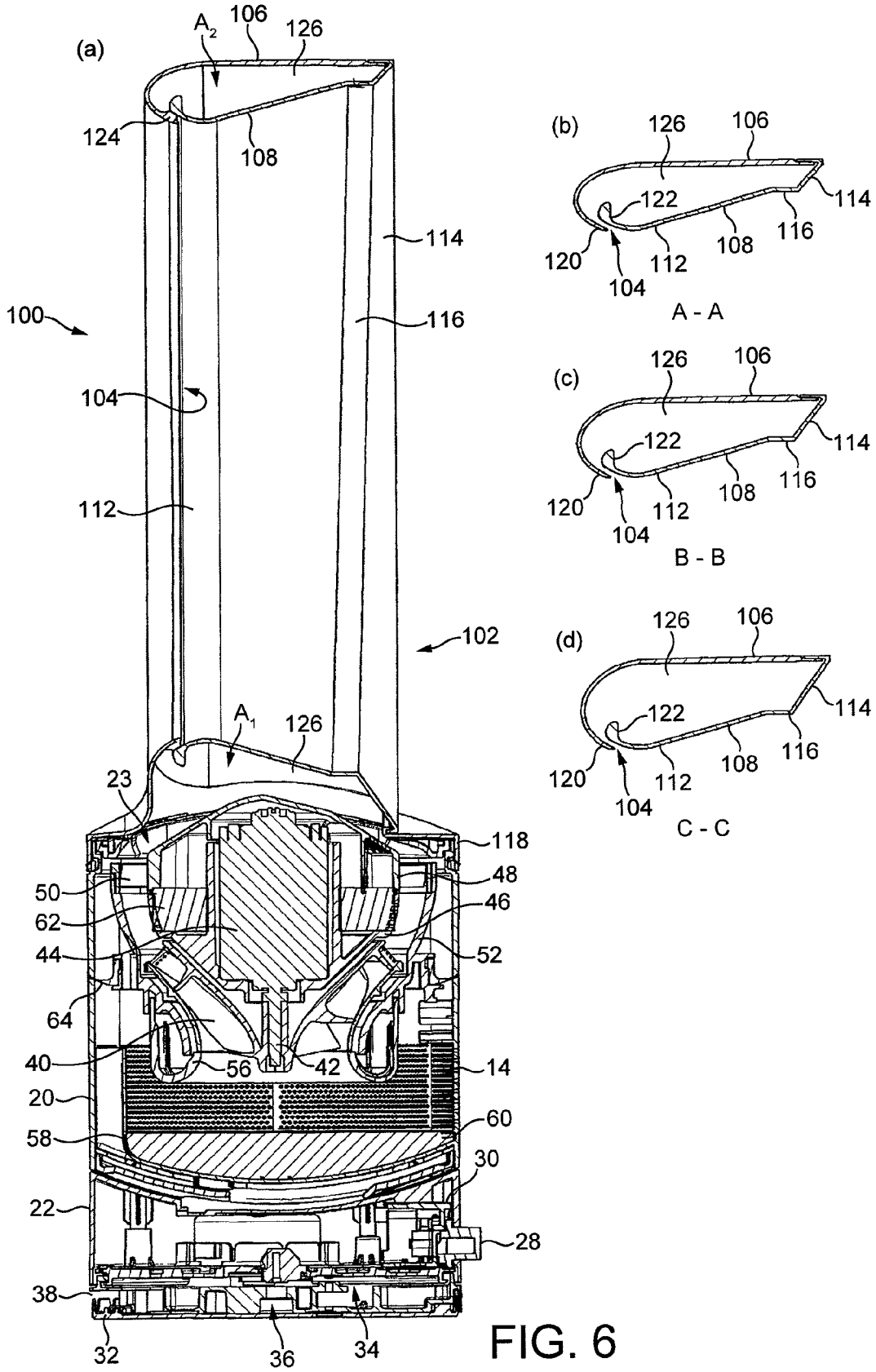
FIG. 6(*a*) is a left side cross-section view, taken along line E-E in FIG. 5.

The outer wall 106 and the inner wall 108 define an interior passage 126 for conveying air from the air inlet 88 to the air outlet 104. The interior passage 126 extends about the bore 110 of the nozzle 102. In view of the eccentricity of the walls 106, 108 of the nozzle 102, the cross-sectional area of the interior passage 126 varies about the bore 110. The interior passage 126 may be considered to comprise first and second curved sections, indicated generally at 128 and 130 in FIGS. 4 and 5, which each extend in opposite angular directions about the bore 110. With reference also to FIGS. 6(*a*) to 6(*d*), similar to the first embodiment each section 128, 130 of the interior passage 126 has a cross-sectional area which decreases in size about the bore 110. The cross-sectional area of each section 128, 130 decreases from a first value $A_1$ located adjacent the air inlet of the nozzle 102 to a second value $A_2$ located diametrically opposite the air inlet, and where ends of the two sections 128, 130 are joined. The relative positions of the axes X, Y are such that each section 128, 130 of the interior passage 126 has the same variation in cross-sectional area about the bore 110, with the cross-sectional area of each section 128, 130 decreasing gradually from the first value $A_1$ to the second value $A_2$. The variation in the cross-sectional area of the interior passage 126 is preferably such that $A_1 \geq 1.5A_2$, and more preferably such that $A_1 \geq 1.8A_2$. As shown in FIGS.

6(*b*) to 6(*d*), the variation in the cross-sectional area of each section 128, 130 is effected by a variation in the radial thickness of each section 128, 130 about the bore 110; the depth of the nozzle 102, as measured in a direction extending along the axes X, Y is relatively constant about the bore 110. In one example, $A_1 \approx 2200\ mm^2$ and $A_2 \approx 1200\ mm^2$.

The operation of the fan assembly 100 is the same as that of the fan assembly 10. A primary air flow is drawn through the air inlet 14 of the base 12 through rotation of the impeller 40 by the motor 44. The primary air flow passes sequentially through the impeller housing 52 and the air outlet 23 at the open upper end of the main body portion 20 to enter the interior passage 126 of the nozzle 102 via the air inlet located in the base 118 of the nozzle 102.

Within the interior passage 126, the primary air flow is divided into two air streams which pass in opposite angular directions around the bore 110 of the nozzle 102, each within a respective section 128, 130 of the interior passage 126. As the air streams pass through the interior passage 126, air is emitted through the air outlet 104. The emission of the primary air flow from the air outlet 104 causes a secondary air flow to be generated by the entrainment of air from the external environment, specifically from the region around the nozzle 102. This secondary air flow combines with the primary air flow to produce a combined, or total, air flow, or air current, projected forward from the nozzle 102. In this embodiment, the variation in the cross-sectional area of the interior passage 126 about the bore 110 can minimise the variation in the static pressure about the interior passage 126.

In summary, a nozzle for a fan assembly has an air inlet, an air outlet, and an interior passage for conveying air from the air inlet to the air outlet. The interior passage is located between an annular inner wall, and an outer wall extending about the inner wall. The inner wall at least partially defines a bore through which air from outside the nozzle is drawn by air emitted from the air outlet. The cross-sectional area of the interior passage varies about the bore. The variation in the cross-sectional area of the interior passage can control the direction in which air is emitted from around the air outlet to reduce turbulence in the air flow generated by the fan assembly. The variation in the cross-sectional area of the interior passage may be achieved by arranging the inner wall so that it is eccentric with respect to the outer wall.

The invention claimed is:

1. A nozzle for a fan assembly, the nozzle comprising:
an air inlet;
at least one air outlet;
an annular inner wall at least partially defining a bore through which air from outside the nozzle is drawn by air emitted from said at least one air outlet, wherein the inner wall comprises an outwardly flared frusto-conical front section;
an outer wall extending about a longitudinal axis and about the inner wall; and
an interior passage located between the inner wall and the outer wall for conveying air from the air inlet to said at least one air outlet;
wherein the interior passage has a first section and a second section each for receiving a respective portion of an air flow entering the interior passage through the air inlet, and for conveying the portions of the air flow in opposite angular directions about the bore;
and wherein each section of the interior passage has a cross-sectional area formed from the intersection with the interior passage of a plane which extends through and contains the longitudinal axis of the outer wall, wherein the cross-sectional area of each section of the interior passage decreases in size about the bore and a length of the outwardly flared frusto-conical front section in a radial direction from the longitudinal axis decreases in size about the bore.

2. The nozzle of claim 1, wherein the cross-sectional area of each section of the interior passage tapers about the bore.

3. The nozzle of claim 1, wherein each section of the interior passage has the same variation in cross-sectional area.

4. The nozzle of claim 1, wherein the cross-sectional area of each section of the interior passage decreases in size about the bore from a first end for receiving air from the air inlet to a second end.

5. The nozzle of claim 1, wherein the cross-sectional area of each section has a minimum value located diametrically opposite the air inlet.

6. The nozzle of claim 1, wherein the cross-sectional area of each section has a first value located adjacent the air inlet and a second value located diametrically opposite the air inlet, and wherein the first value is at least 1.5 times the second value.

7. The nozzle of claim 6, wherein the first value is at least 1.8 times the second value.

8. The nozzle of claim 1, wherein each section of the nozzle has a substantially constant depth about the bore.

9. The nozzle of claim 1, wherein the inner wall is eccentric with respect to the outer wall.

10. A nozzle for a fan assembly, the nozzle comprising:
an air inlet;
at least one air outlet;
an interior passage for conveying air from the air inlet to said at least one air outlet;
an annular inner wall comprising an outwardly flared frusto-conical front section; and
an outer wall extending about a longitudinal axis and about the inner wall, the interior passage being located between the inner wall and the outer wall, the inner wall at least partially defining a bore through which air from outside the nozzle is drawn by air emitted from said at least one air outlet;
wherein the inner wall is eccentric with respect to the outer wall, the nozzle has a substantially constant depth about the bore, and a length of the outwardly flared frusto-conical front section in a radial direction from the longitudinal axis decreases in size about the bore.

11. The nozzle of claim 10, wherein each of the inner wall and the outer wall extends about a respective longitudinal axis, and wherein the longitudinal axis of the outer wall is located between the air inlet and the longitudinal axis of the inner wall.

12. The nozzle of claim 11, wherein the longitudinal axis of the inner wall is located vertically above the longitudinal axis of the outer wall.

13. The nozzle of claim 10, wherein the interior passage has a cross-sectional area which varies in size about the bore.

14. The nozzle of claim 13, wherein the cross-sectional area of the interior passage has a minimum value located diametrically opposite the air inlet.

15. The nozzle of claim 13, wherein the cross-sectional area of the interior passage has a first value located adjacent the air inlet and a second value located diametrically opposite the air inlet, and wherein the first value is at least 1.5 times the second value.

16. The nozzle of claim 15, wherein the first value is at least 1.8 times the second value.

17. The nozzle of claim 10, wherein the nozzle has a radial thickness which varies in size about the bore.

* * * * *